United States Patent [19]

Goldstone et al.

[11] Patent Number: 4,994,243

[45] Date of Patent: Feb. 19, 1991

[54] CYANIDE REGENERATION PROCESS

[75] Inventors: Adrian J. Goldstone, Waihi Beach, New Zealand; Terry I. Mudder, Duvall, Wash.

[73] Assignee: Cyprus Minerals Company, Englewood, Colo.

[21] Appl. No.: 261,386

[22] Filed: Oct. 21, 1988

[51] Int. Cl.[5] ..... C22B 11/08; C01C 3/08

[52] U.S. Cl. ..... 423/29; 75/737; 423/30; 423/31; 423/379

[58] Field of Search ..... 75/105; 423/29, 30, 423/31, 379

[56] References Cited

U.S. PATENT DOCUMENTS

| | | | |
|---|---|---|---|
| 494,054 | 3/1893 | Birkin | 75/105 |
| 496,950 | 5/1893 | Parkes et al. | 75/105 |
| 705,698 | 7/1902 | Officer et al. | 423/30 |
| 820,810 | 5/1906 | Muffly | 75/105 |
| 823,576 | 6/1906 | Arnold | 423/30 |
| 1,387,289 | 8/1921 | Mills et al. | 423/29 |
| 3,403,020 | 9/1968 | Lower | 75/106 |
| 3,592,586 | 7/1971 | Scott | 23/79 |
| 3,617,567 | 11/1971 | Mathre | 210/50 |
| 4,250,030 | 2/1981 | Kuit et al. | 210/684 |
| 4,267,159 | 5/1981 | Crits | 423/371 |
| 4,312,760 | 1/1982 | Neville | 210/724 |
| 4,537,686 | 8/1985 | Borbely et al. | 210/713 |
| 4,587,110 | 5/1986 | Potter et al. | 423/30 |
| 4,654,079 | 3/1987 | Nunez et al. | 423/30 |
| 4,708,804 | 11/1987 | Coltrinari | 210/677 |
| 4,734,270 | 3/1988 | Touro et al. | 423/30 |
| 4,752,400 | 6/1988 | Pearson | 210/718 |

FOREIGN PATENT DOCUMENTS

| | | | |
|---|---|---|---|
| 698706 | 11/1964 | Canada | 423/29 |
| 8808408 | 11/1988 | World Int. Prop. O. . | |
| 8901357 | 2/1989 | World Int. Prop. O. . | |

OTHER PUBLICATIONS

"Cyanide and the Environment", (A Collection of Papers from the Proceedings of a Conference held in Tucson, Arizona, Dec. 11–14, 1986) edited by Dirk Van Zyl.

"Cyanidation and Concentration of Gold and Silver Ores", by Dorr and Bosqui, 2nd edition, published by McGraw-Hill Book Company, 1950.

"Canmet AVR Process for Cyanide Recovery and Environmental Pollution Control Applied to Gold Cyanidation Barren Bleed from Campbell Red Lakes Mines, Limited, Balmerton, Ontario", by Vern M. McNamara, Mar. 1985.

"Removal of Cyanide from Gold Mill Effluents", by Ingles and Scott, presented at the Canadian Mineral Processors 13th Annual Meeting, Ottawa, Ontario, Canada, Jan. 20–22, 1981.

"Overview of Cyanide Treatment Methods", by Ingles and Scott, presented at the Canadian Mineral Processors 13th Annual Meeting, Ottawa, Ontario, Canada, Jan. 20–22, 1981.

"Golconda Claims World First for Cyanide Regeneration Process", by Doug Wilson, Gold Gazette, Dec. 7, 1987, p. 35.

"New Process Regnerates Cyanide from Gold and Silver Leach Liquors", *The Engineering and Mining Journal*, Jun. 1988, p. 55.

"Cyanide Regeneration", *Mining*, Jul. 1988, pp. 60–61.

"Cyanide Regeneration from Gold Tailings—Golconda's Beaconsfield Experience", by Michael J. Kitney, *Perth Gold* 88, pp. 89–93.

(List continued on next page.)

*Primary Examiner*—Wayne A. Langel

*Attorney, Agent, or Firm*—Sheridan, Ross & McIntosh

[57] ABSTRACT

A process for removing and recovering cyanide from a cyanide-containing solution. The process includes the steps of adjusting the pH of the cyanide-containing solution to between about pH 6 and about pH 9.5, volatilizing the HCN contained in the pH adjusted solution and contacting the volatilized HCN with basic material. Preferably, the cyanide recovery process is performed on tailings slurries resulting from metal recovery processes.

27 Claims, 3 Drawing Sheets

OTHER PUBLICATIONS

"New Hydrometallurgical Process for Au Recovery from Cyanide Solution", *Mining Magazine,* Jan. 1988, pp. 60–61.

"The Application of Cyanide Regeneration to the Treatment of Refractory, Complex or Copper Bearing Ores as Practiced by Companie de Real Del Montey Pauchuca", by Frank A. Seeton.

"Stripping of HCN is a Packed Tower", by Avedesian, Spira and Canduth, *The Canadian Journal of Chemical Engineering,* vol. 61, Dec. 1983, pp. 801–806.

"Vapor–Liquid Equilibria in Multicomponent Aqueous Solutions of Volatile Weks Electrolytes", by Edwards, Maurer, Newman and Prausnitz, AIChE Journal, vol. 24, No. 6, Nov. 1978, pp. 966–976.

"Precious Metals", Section 18 by McQuiston, Jr. and Shoemaker.

"*Principles of Industrial Waste Treatment*", by Gurnham, section entitled, Ion Exchange Applications, pp. 242–245.

CYANIDE REGENERATION PROCESS

FIELD OF THE INVENTION

The present invention relates to cyanide removal and recovery from cyanide-containing solutions.

BACKGROUND OF THE INVENTION

Cyanides are useful materials industrially and have been employed in fields such as electro-plating of metals, gold recovery from ores, treatment of sulfide ore slurries in flotation, etc. Due to environmental concerns, it is desirable to remove or destroy the cyanide present in the waste solutions resulting from such processes. Additionally, in view of the cost of cyanide, it is desirable to regenerate the cyanide for reuse.

Techniques for cyanide disposal or regeneration in waste solutions include: ion exchange, oxidation by chemical or electrochemical means, and acidification-volatilization-reneutralization (AVR).

U.S. Pat. No. 4,267,159 by Crits issued May 12, 1981, discloses a process for regenerating cyanide in spent aqueous liquor by passing the liquor through a bed of suitable ion exchange resin to segregate the cyanide.

U.S. Pat. No. 4,708,804 by Coltrinari issued Nov. 24, 1987, discloses a process for recovering cyanide from waste streams which includes passing the waste stream through a weak base anion exchange resin in order to concentrate the cyanide. The concentrated cyanide stream is then subjected to an acidification/volatilization process in order to recover the cyanide from the concentrated waste stream.

U.S. Pat. No. 4,312,760 by Neville issued Jan. 26, 1982, discloses a method for removing cyanides from waste water by the addition of ferrous bisulfite which forms insoluble Prussian blue and other reaction products.

U.S. Pat. No. 4,537,686 by Borbely et al. issued Aug. 27, 1985, discloses a process for removing cyanide from aqueous streams which includes the step of oxidizing the cyanide. The aqueous stream is treated with sulfur dioxide or an alkali or alkaline earth metal sulfite or bisulfite in the presence of excess oxygen and a metal catalyst, preferably copper. This process is preferably carried out at a pH in the range of pH 5 to pH 12.

U.S. Pat. No. 3,617,567 by Mathre issued Nov. 2, 1971, discloses a method for destroying cyanide anions in aqueous solutions using hydrogen peroxide ($H_2O_2$) and a soluble metal compound catalyst, such as soluble copper, to increase the reaction rate. The pH of the cyanide solution to be treated is adjusted with acid or base to between pH 8.3 and pH 11.

Treatments based on oxidation techniques have a number of disadvantages. A primary disadvantage is that no cyanide is regenerated for reuse. Additionally, reagent costs are high, and some reagents (e.g. $H_2O_2$) react with tailing solids. Also, in both the Borbely et al and Mathre processes discussed above, a catalyst, such as copper, must be added.

U.S. Pat. No. 3,592,586 by Scott issued July 13, 1971, describes an AVR process for converting cyanide wastes into sodium cyanide in which the wastes are heated and the pH is adjusted to between about pH 2 and about pH 4 in order to produce hydrogen cyanide (HCN). The HCN is then reacted with sodium hydroxide in order to form sodium cyanide. Although the process disclosed in the Scott patent is described with reference to waste produced in the electro-plating industry, AVR processes have also been applied to spent cyanide leachate resulting from the processing of ores. Such spent cyanide leachate typically has a pH greater than about pH 10.5.

AVR processes employed in the mineral processing field are described in the two volume set "Cyanide and the Environment" (a collection of papers from the proceedings of a conference held in Tucson, Ariz., Dec. 11–14, 1984) edited by Dirk Van Zyl, "Cyanidation and Concentration of Gold and Silver Ores," by Dorr and Bosqui, Second Edition, published by McGraw-Hill Book Company 1950, and "Cyanide in the Gold Mining Industry: A Technical Seminar," sponsored by Environment Canada and Canadian Mineral Processor, Jan. 20–22, 1981. Another description of an AVR process can be found in "Canmet AVR Process for Cyanide Recovery and Environmental Pollution Control Applied to Gold Cyanidation Barren Bleed from Campbell Red Lakes Mines Limited, Balmerton, Ontario," by Vern M. McNamara, March 1985. In the Canmet process, the barren bleed was acidified with $H_2SO_4$ to a pH level typically between 2.4 and 2.5. $SO_2$ and $H_2SO_3$ were also suitable for use in the acidification.

AVR processes take advantage of the very volatile nature of hydrogen cyanide at low pH. In an AVR process, the waste stream is first acidified to a low pH (e.g. pH 2 to pH 4) to dissociate cyanide from metal complexes and to convert it to HCN. The HCN is volatilized, usually by air sparging. The HCN evolved is then recovered, for example, in a lime solution, and the treated waste stream is then reneutralized. A commercialized AVR method known as the Mills-Crowe method is described in Scott and Ingles, "Removal of Cyanide from Gold Mill Effluents," Paper No. 21 of the Canadian Mineral Processors 13 Annual Meeting, in Ottawa, Ontario, Canada, Jan. 20–22, 1981.

The AVR processes described in the Scott patent and the above-mentioned texts typically include the step of adjusting the pH of the spent cyanide stream to within the range from about pH 2 to about pH 4. There are several problems with such processes. Such AVR processes are expensive due to the amount of acidifying agent required to lower the pH to within this range. Also, such processes require a substantial amount of base to reneutralize the waste stream after the volatilization of HCN and prior to disposal. Further, insoluble metal complexes form at the acid conditions employed in these processes. The above-mentioned references only disclose a treatment of barren bleed which typically results from Merrill-Crowe type cyanidation treatment of ore. This bleed does not contain solid tailings. Today many ores are treated by a carbon-in-leach or carbon-in-pulp cyanidation process. The tailings from such processes include the solid barren ore in the spent leachate. Typically the tailing slurries contain about 30% to 40% solids and about 100 to 350 ppm cyanide. In the past, such tailings were typically impounded and the cyanide contained therein was allowed to degrade naturally. However, due to environmental concerns about cyanide, such impoundment is not a desirable alternative in many situations.

Therefore, it would be advantageous to remove cyanide from a cyanide-containing waste stream in an economical manner. Further, it would be advantageous to provide a process for treating cyanide-containing slurries which also contain ore tailings. It would be advantageous if the amount of cyanide present in the waste stream could be reduced. It would also be advantageous to regenerate the cyanide for reuse.

It has now been found that when the HCN is volatilized at pH ranges higher than those previously employed, significant advantages are achieved. For example, cost savings can be realized due to the reduced amounts of reagents required to acidify and subsequently raise the pH of the waste stream. Additionally, many insoluble complexes which form under strong acid conditions will not form in the pH range employed in the present process.

The pH ranges successfully employed in the present invention are possible because the present invention is preferably conducted on fresh carbon-in-pulp or carbon-in-leach tails. In contrast, previous acidification-volatilization-reneutralization (AVR) processes were employed on decant water or on barren bleed from Merrill-Crowe gold cyanidation processes. In the present process, much of the cyanide in the waste stream is in ionic form or only weakly complexed, whereas in barren bleed there is significant complexing including insoluble and strongly complexed forms. Therefore, previous AVR processes optimized the acidic precipitation of some of the metallo-complexes in order to deal with such precipitates separately.

SUMMARY OF THE INVENTION

In accordance with the present invention, a process is provided for regenerating cyanide from a cyanide-containing solution. Although it is anticipated that the process can be performed on numerous cyanide-containing solutions, in a preferred embodiment the solution is a slurry which includes tailings from a mineral recovery process. The process includes the steps of: (1) adjusting the pH of the cyanide-containing solution to between about pH 6 and about pH 9.5, (2) volatilizing the HCN contained in the pH adjusted solution, and (3) contacting the volatilized HCN with basic material.

In a preferred embodiment, the cyanide-containing solution comprises the tailing slurry resulting from a carbon-in-leach or carbon-in-pulp gold recovery process. In such an instance, the regenerated cyanide can be recycled to the gold recovery circuit. The tailings which remain after the HCN is volatilized can optionally be treated in order to coagulate metal complexes. Such treatment can include the addition of $FeCl_3$ or "TMT," an organic sulfide (reported to be sodium-triazine—2, 4, 6 trimercaptide) available from DeGussa Corporation. A base (e.g. $Na_2CO_3$ or lime) can be added to raise the pH of the tailings to about pH 9.5 to about pH 10.5 in order to precipitate metals. The tailings then can be impounded or subjected to additional treatment to further reduce the cyanide content.

DETAILED DESCRIPTION OF THE INVENTION

Figure 1:
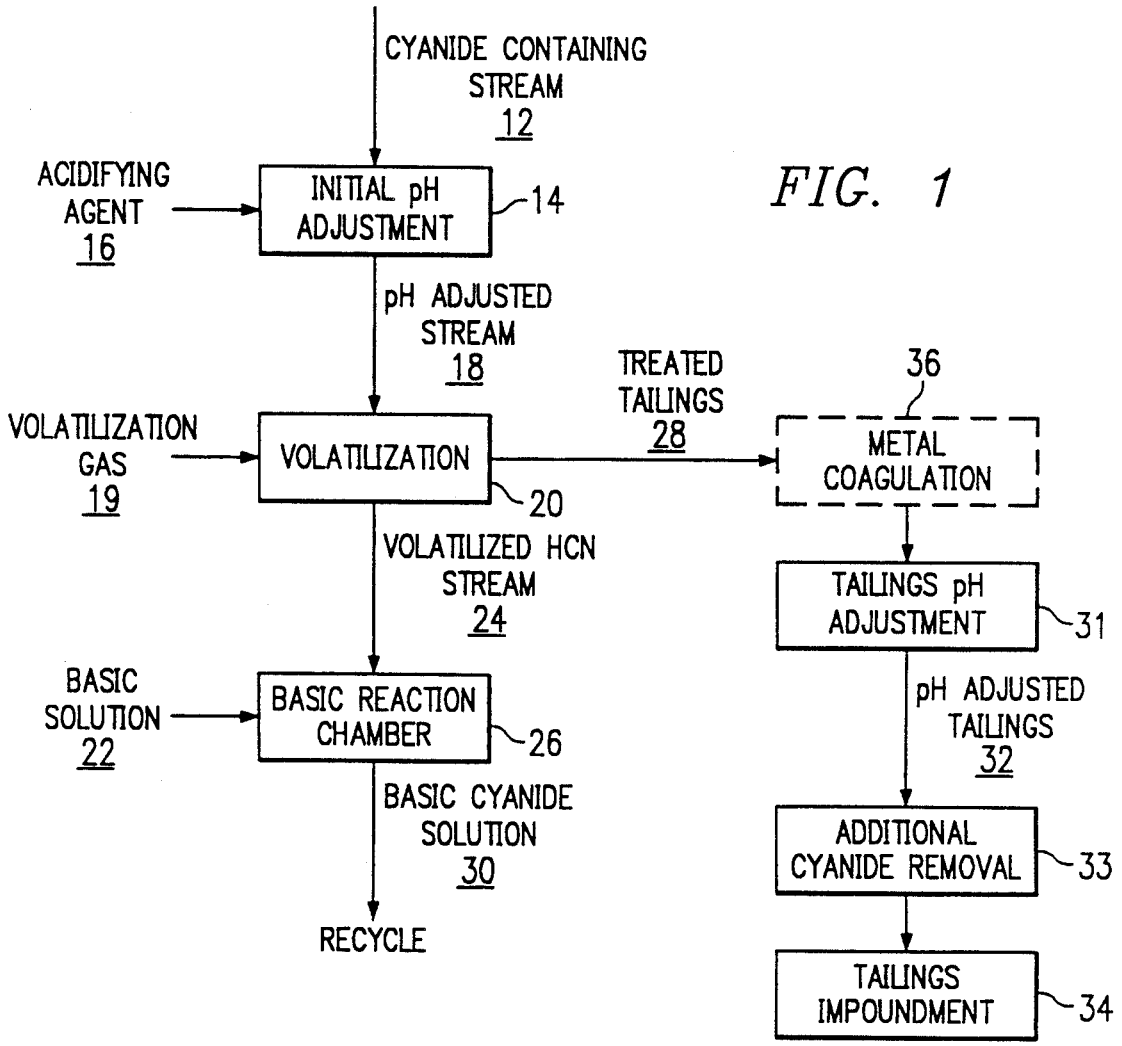
FIG. 1 is a block diagram of one embodiment of the present invention.

The present invention concerns a process for regenerating cyanide from cyanide-containing waste streams. The process is preferably performed on tailings slurries resulting from mineral recovery processes, e.g. gold recovery processes employing cyanide leach solutions, such as carbon-in-leach and carbon-in-pulp processes. Such tailings slurries typically have a pH of greater than about pH 10.5, contain about 30% to 40% solids and about 100 to 350 ppm cyanide.

A first step in the process involves adjusting the pH of the stream being treated to between pH 6 and pH 9.5, more preferably between pH 7 and pH 9, and most preferably to about pH 8. This can be accomplished through the use of an acidifying agent, such as $H_2SO_4$. Proper adjustment of the pH results in the formation of HCN in solution. The HCN is volatilized, preferably by contacting with air. The volatilized HCN is then contacted with a basic material, preferably having a pH between about pH 11 and pH 12. The HCN is converted to caustic cyanide. Useful basic materials include $Na_2CO_3$ and lime, preferably in solution. However, the use of lime is not preferred because of the potential for the formation of $CaSO_4$ scale.

The tailings remaining after the HCN volatilization step can be further treated to remove remaining cyanide and/or metals and metal complexes. Such optional treatment may include metal coagulation, pH adjustment of the tailings in order to precipitate metal complexes, and/or further cyanide removal by known treatments such as oxidation (e.g. with $H_2O_2$ or $SO_2$) and/or biological treatments.

As a result of the process of the present invention, treated ore tailings have a greater long-term stability. Potentially toxic species (e.g. silver) will be less likely to be mobilized because of the lower cyanide concentration in the tailings pond. Discharge concentrations can be lowered and management requirements after mine closure reduced.

Previous AVR processes used a low pH precipitation step. This is to be contrasted with the present process which does not use a low pH precipitation step. Instead, the present process uses pH in the range of about pH 6 to about pH 9.5. An advantage of eliminating the low pH step is that the higher pH reduces the amount of acid required to be added to initially acidify the waste stream. The amount of base required to subsequently raise the pH of the treated stream is also reduced.

The present process will be described with reference to FIG. 1. A cyanide-containing waste stream 12 is treated 14 in order to obtain a pH between pH 6 and pH 9.5 and more preferably between about pH 7 and about pH 9 and most preferably about pH 8. In a preferred embodiment, the cyanide-containing waste stream is a tailings slurry from a carbon-in-pulp or carbon-in-leach metal recovery process normally having a pH of at least about 10.5, about 30% to 40% solids content and about 100 to 350 ppm cyanide. It is not believed to be advantageous to lower the pH below about pH 6. Additionally, at pH ranges below about pH 3 or pH 4, some metal complexes (e.g. $CuCN_2$) will precipitate and subsequently resolubilize when the pH is increased.

The cyanide-containing stream 12 is acidified 14 by adding an acidifying agent. The acidifying agent 16 is preferably $H_2SO_4$, but other acids can be used such as hydrochloric acid, acetic acid, nitric acid, etc. as well as mixtures of acids. The particular acid of choice will depend on such factors as economics and composition of the stream being treated. For example, if the stream contains materials which are detrimentally affected by an oxidizing agent, nitric acid would probably not be useful. A potential problem which was anticipated prior to the reduction to practice of the present invention was the formation of $CaSO_4$ precipitates if $H_2SO_4$ was added to slurries containing ore tailings. Surprisingly, this problem was not as severe as originally anticipated. The function of the acidifying agent 16 is to reduce the pH in order to shift the equilibrium from cyanide/metal complexes to $CN^-$ and ultimately to HCN. By employing higher pH ranges than those used in prior art AVR processes, the amount of acidifying agent 16 required is substantially reduced.

Figure 2:
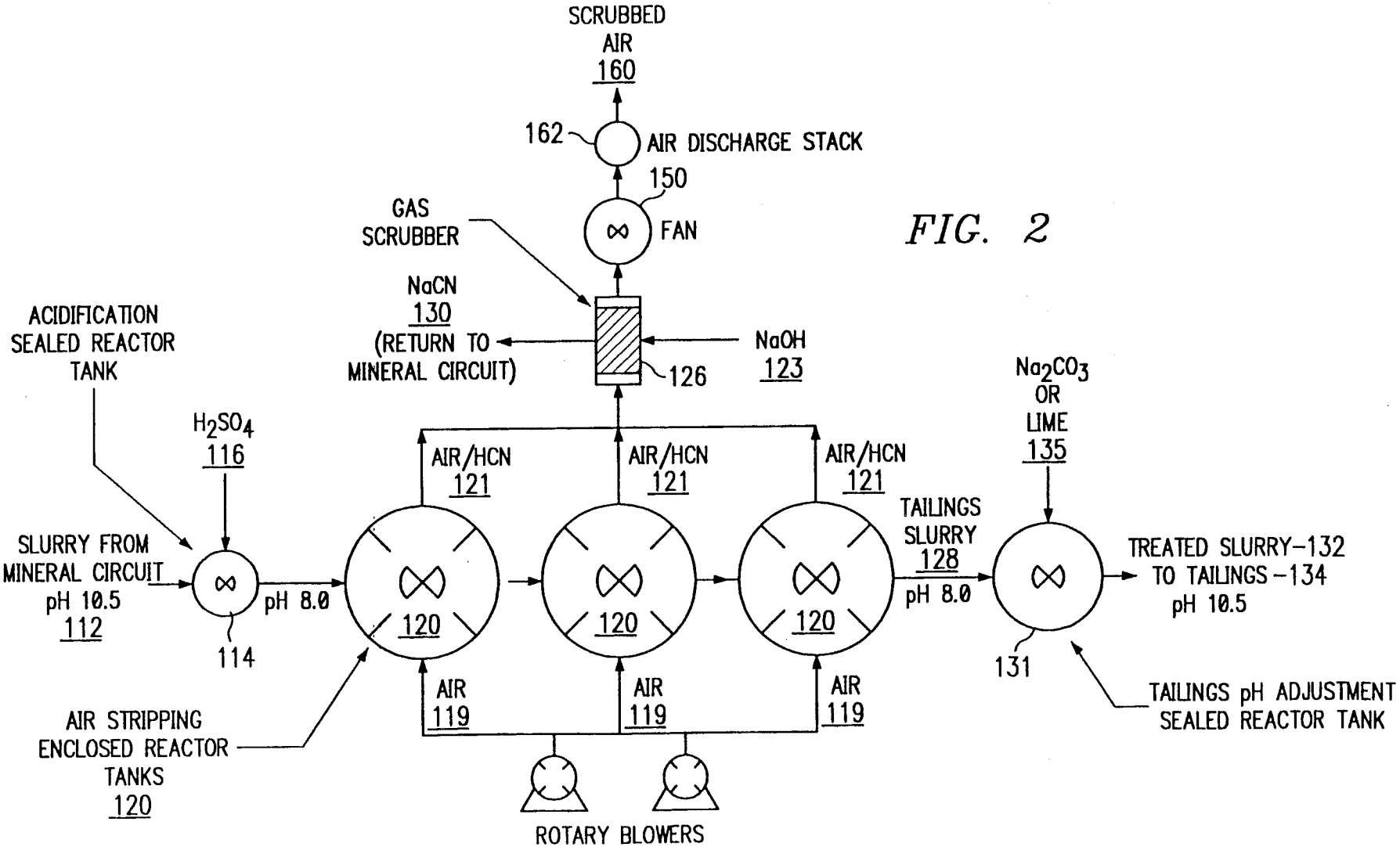
FIG. 2 illustrates a preferred embodiment of the regeneration process of the present invention.

Preferably, as shown in FIG. 2, the pH of the incoming mill tailings slurry 112 is adjusted downward from around pH 10.5 to between pH 6 and pH 9.5. This is accomplished in a sealed, mixed reactor vessel 114 with approximately 15 minutes detention time. The vessel 114 should be constructed of materials compatible with the abrasive nature of this process. The acidifying agent 116, preferably $H_2SO_4$, is normally added in the form of a 10% aqueous solution.

The pH adjusted stream 18 is then removed to a volatilization section 20 as shown in FIG. 1. In the volatilization step 20, HCN is transferred from the liquid phase to the gas phase. Air is a preferred volatilization gas, 19, and can also provide the turbulence required. Air can be provided to the pH adjusted liquor in the volatilization step 20 by any method well known in the art. For example, a diffuser basin or channel can be used without mechanical dispersion of the air. Alternatively, an air sparged vessel and impeller for dispersion can be employed. In other alternative embodiments, a modified flotation device or a countercurrent tower with a grid or board can be used.

Volatilization of HCN by gas stripping involves the passage of a large volume of low pressure compressed gas through the acidified slurry to release cyanide from solution in the form of HCN gas. Alternatively, the slurry can be introduced into the volatilization gas, e.g. in a countercurrent flow tower. In the preferred embodiment shown in FIG. 2, volatilization is accomplished in a series of enclosed mixer reactor units 120. Three such units 120 are depicted having approximately 45 minutes detention time each, to yield slightly over 2 hours total air stripping time.

Incoming compressed air 119 is evenly distributed across the base of the stripping reactor 120 using air sparger units designed to eliminate slurry entering the air pipework on cessation of air flow. Stripping air flow 121 is continuously removed from the enclosed atmosphere above the slurry by the extraction air 160 drawn from the scrubber section. Preferred air flows 119 are from 360 to 600 cubic meters air per cubic meter pH adjusted solution per hour, over a period of about 3 to 4 hours. This corresponds to a flux of from 3.4 to 5.6 cubic meters air per square meter pH adjusted solution per minute, over the same period. While the key function of air in the system is to provide an inert carrier gas and transport, the air also has secondary effects. The first is to provide energy to overcome barriers to HCN transfer to the gas phase. Although HCN is very volatile, having a boiling point of about 26° C., it is also infinitely soluble in water, and HCN solutions have a high degree of hydrogen bonding. Thus, there are significant resistances to the mass transfer of HCN that can be overcome by using the sparged air to provide the necessary energy in the form of turbulence. Furthermore, the disassociation equilibrium constants for most of the metal-cyanide complexes are so low at the desired pH ranges that $CN^-$ must be as close to zero as possible in order to push the equilibrium far enough toward $CN^-$ formation in order to dissociate the complexes. This can be achieved by efficient removal of $CN^-$ to HCN, which is pH dependent, and then by removal of HCN from the solution, which is energy dependent.

Preferred retention time in the volatilization step 20 is from about 3 to about 4 hours. Preferably the static liquid height in the volatilization reactor 120 is less than 3 meters. This is due to the factors related to the function of air in the system and the possibility of bubble coalescence if the depth is greater than about 3 meters.

As shown in FIG. 1, the volatilized HCN stream 24 is introduced into a basic reaction chamber 26, e.g. a conventional packed countercurrent scrubber (126 shown in FIG. 2). Basic material, preferably in solution 22, is fed to the chamber 26 preferably at a pH between about pH 11 and about pH 12, in order to absorb HCN gas. The basic cyanide solution 30 can be recycled, e.g. to a mineral recovery process such as a gold cyanidation process.

Preferably HCN recovery takes place in packed tower systems with countercurrent flow of air-HCN and, for example, NaOH. Alternatively, a perforated plate tower employing, e.g. milk of lime, can be used. NaOH is preferred over lime to reduce calcium in the circuit and reduce possible $CaSO_4$ precipitation.

In a preferred embodiment, shown in FIG. 2, hydrogen cyanide is removed from the stripping air 121 by promoting a reaction with sodium hydroxide (caustic soda) 123 in solution to form sodium cyanide 130. This is effectively achieved within a scrubber unit 126 by drawing the stripping air 121 vertically through the scrubber bed, countercurrent to a caustic solution 123 irrigating the bed media. The caustic solution 123 is recycled across the bed via duty and standby pumps with a proportion of the solution bled off to prevent the continuous build up of cyanide removed from the air 121. Sodium hydroxide 123 is automatically dosed into the scrubber liquid to maintain a constant pH thereby allowing for the portion lost to bleed. Cyanide, now in the form of a caustic solution of sodium cyanide bleed 130, is returned by pump to the mill circuit for reuse.

Figure 3:
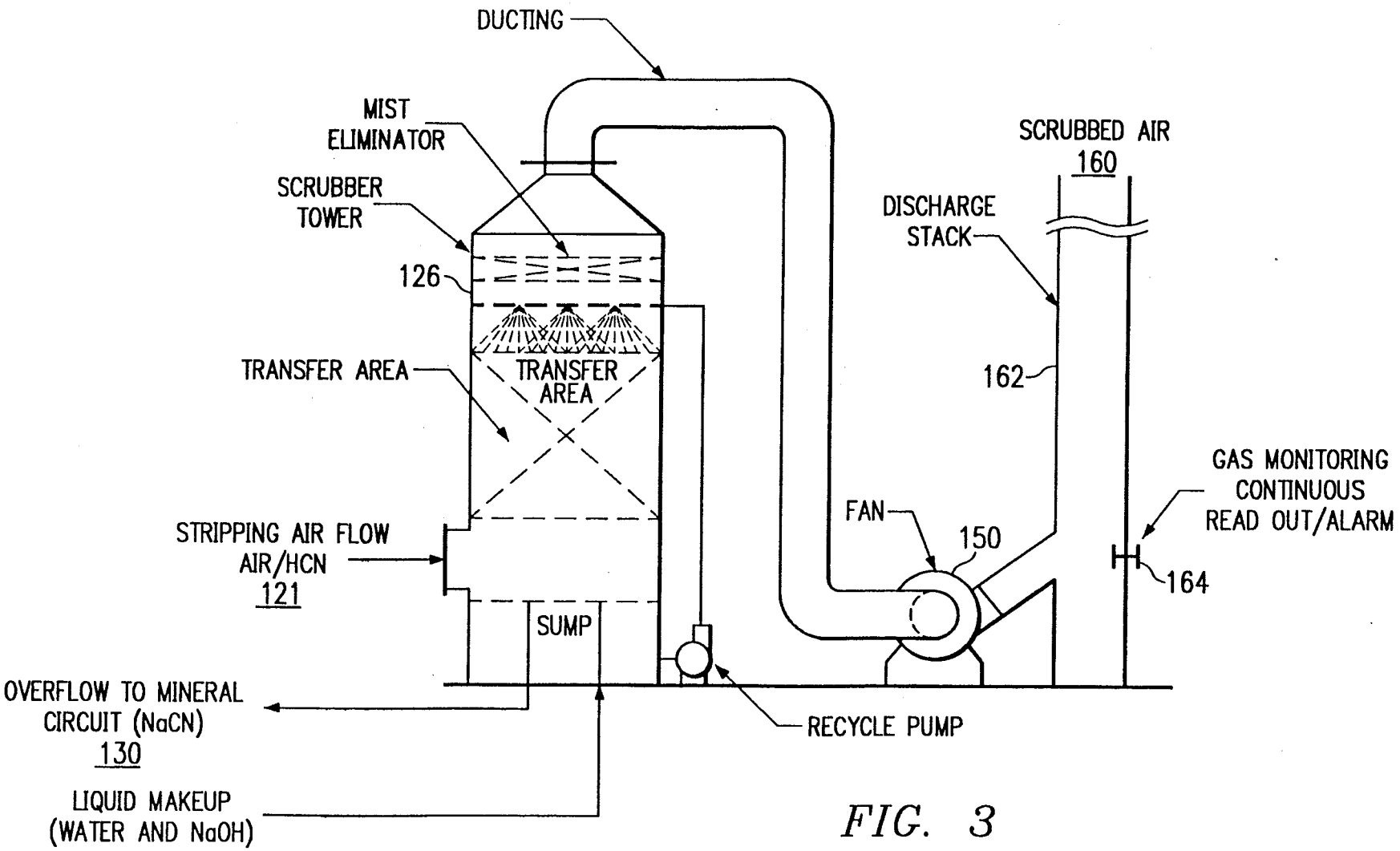
FIG. 3 illustrates a preferred embodiment of the basic reaction step of the process illustrated in FIG. 2.

A preferred embodiment of the scrubber unit 126 is shown in FIG. 3. Preferably all ducting, scrubbing towers, fans and discharge stack are constructed with glass reinforced plastic. Packing within the scrubbing towers is provided to yield high gas to liquid contact and eliminate short circuiting. Packing is preferably in the form of polypropylene media.

The scrubbing unit design shown in FIG. 3 allows for the siting of the main air drawing fans 150 between the scrubbers and the discharge stack 162. In this configuration, and with the fans 150 set to always exceed the flow rate of stripping air 121, the scrubber unit 126, its intake ducting and stripping vessel covers, all operate under negative pressure. This reduces the possibility of leaking of stripping air 121 before it is scrubbed of HCN.

Discharge of scrubbed air 160 to atmosphere is via stack 162. The stack 162 can be installed with gas monitoring equipment 164 to provide a continuous readout of performance and can include detection of high levels of cyanide.

Preferably, the scrubbing unit 126 allows for a minimum of 98% HCN removal from the stripping air 121. On this basis the concentration of HCN exiting the scrubber bed is maintained at less than $10 mg/m^3$.

The pH of the treated tailings 28 which remain after the HCN volatilization step 20 can be readjusted 31 upward to a range of about pH 9.5 to about pH 10.5 in order to precipitate metals. The neutralized tailings 32 can then be impounded 34. Optionally, prior to the pH adjustment step 31, complexed metals can be coagulated 36 by methods known in the art, for example using $FeCl_3$ or TMT, an organic sulfide available from DeGussa Corporation. Additional cyanide can also be removed 33 from the treated tailings 32, for example by known oxidation techniques, e.g. using $H_2O_2$ or $SO_2$, or by known biological processes.

In a preferred embodiment, shown in FIG. 2, the tailings slurry 128 is passed to unit 131 for correction of the pH to about pH 9.5 to about pH 10.5. This reaction is preferably accomplished in a sealed, mixed reactor vessel 131 of approximately 20–30 minutes detention time. The vessel 131 is constructed of materials compatible with the abrasive nature of this process. A base 135 is added, preferably in the form of $Na_2CO_3$ or lime in solution. The stripped tailings slurry 132 then reports to the tailings pump for disposal to the tailings impoundment 134.

While not wishing to be bound by any mechanism, it is believed that the process of the present invention operates as follows.

When the pH of the tailings is adjusted to between pH 6 and pH 9.5, the $CN^-$ complexes (with the exception of Fe and Co complexes) dissociate to form $CN^-$ and ultimately HCN:

$$CN_{complexes} \rightarrow CN^- \rightarrow HCN$$

These equations represent equilibrium reactions in which the process of the present invention shifts the equilibrium to the right-hand side. In the volatilization section 20, the HCN in solution is volatilized to HCN gas:

$$HCN_{solution} \rightarrow HCN_{gas}$$

This preferably occurs under an overall pH of about 8 and a high energy environment of the volatilization section 20. In the basic reaction chamber 26 the high pH causes the equilibrium to shift back towards HCN in solution:

$$HCN_{gas} \rightarrow HCN_{solution}$$

Although the process has been described with reference to tailings slurry from a carbon-in-leach or carbon-in-pulp mineral recovery process, it is to be expressly understood that the process can also be employed on other cyanide-containing streams, e.g. from other mineral recovery processes, electro-plating processes, etc.

The following experimental results are provided for the purpose of illustration of the present invention and are not intended to limit the scope of the invention.

EXAMPLES

A. Equipment

The apparatus employed in Examples 1 and 2 consists of two 3' plexiglass columns six inches in diameter, connected in series, and sealed on both ends with plexiglass plates. The two columns are connected by tubing to permit the flow of air into the bottom of the first column, up through the column where it exits at the top, and then enters the bottom of the second column, flows through the column and exits at the top of the second column. A flow meter was employed to measure the flow of air entering the bottom of the first column. The column nearest the flow meter operated as the acidification-volatilization column, while the second column operated as the absorption column. Tubing was attached to the absorption column and ran into a fume hood to vent the air and any cyanide not absorbed.

The aeration system was capable of producing a continuous flow of air in the range of 0–10 scfm at pressures of 10–20 psi. A compressor was employed for this purpose. The compressor was attached to the flow meter via tubing which was then attached to the first column. A regulator between the compressor and the flow meter was employed to regulate and record the pressure being applied to the system.

A pipe was attached in each bottom plate of the two columns to facilitate sampling and draining of the columns during and following an experiment.

B. Procedure

In Examples 1, 2 and 3, a specific pH and air flow were utilized and the extent of cyanide stripping and recovery was evaluated over time. The air flow passed from the compressor, through the regulator, the flow meter, and the first volatilization column, and finally through the second absorption column. The air flow exiting the second column passed into a fume hood to vent unabsorbed cyanide.

EXAMPLE 1

The ore used in Example 1 was prepared by grinding 25 kilograms of ore together with 13.5 kilograms of water (i.e. 65% solids) and 240 grams of $Ca(OH)_2$ (i.e. 9.6 kilograms per ton) for 42 minutes in order to achieve a particle size distribution of about 85% of the ore less than 45 microns in size. Twenty kilograms of water were added after grinding in order to thin the slurry. The slurry was ground a total of 3 times. Makeup water (9.6 kilograms) was added at the completion of the three grinds and the pH was adjusted to pH 10.5.

The slurry was leached with cyanide. Initially, 83.5 grams of NaCN as a 5% solution was added. After 2 hours, 33 additional grams of NaCN (5% solution) was added as the cyanide concentration had dropped. The total cyanide added to the system was equivalent to 385 parts per million cyanide. During leaching, an air flow of 1 liter per minute was maintained. The pH and cyanide concentration of the leach slurry was monitored hourly. No further additions of NaCN were needed. The final cyanide concentration was measured at 210 parts per million. Finally, carbon was added after 16 hours. However, the gold and silver concentrations were not monitored. After removal of the carbon, the composition of the barren leachate was measured prior to stripping. The composition is shown in Table I.

TABLE I

| Composition of Barren Leachate Before Stripping | |
|---|---|
| pH | 10.3 |
| Alkalinity | 475 |
| Ammonia-N | 1 |
| Cyanate | 23 |
| Cyanide (Total) | 202, 192 |
| Cyanide (WAD) | 200, 190 |
| Sulphate | 320 |
| Thiocyanate | 24 |
| Arsenic | 0.8 |
| Copper | 3.90 |
| Iron | 0.15 |
| Silver | 0.06 |
| Zinc | 2.10 |

For each of the six runs of Example 1, 10 liters of the slurry prepared as described above were placed in the first volatilization column. Initial samples of the solution were analyzed for free cyanide (for example, by ion selective electrode or by silver nitrate titration), the weak acid dissociable cyanide ($CN_{WAD}$ - by ASTM Method C), and pH. For runs 1 and 2 the initial pH was not adjusted. For runs 3 and 4 the pH was adjusted with $H_2SO_4$ to pH 8.7. For runs 5 and 6 the pH was adjusted to pH 7.6.

Ten liters of caustic solution was placed in column 2 (the absorption column). The caustic solution was prepared by adding sufficient sodium hydroxide pellets to bring the pH of the solution to about pH 11 to about pH 11.5.

Air was then introduced into the columns. In runs 1, 3 and 5, the air flow rate was 60 liters per minute (±20%) and in runs 2, 4 and 6, the air flow rate was 82 liters per minute (±20%). Table II summarizes the pH and air flow rates for each of the runs in Example 1.

TABLE II

| | Conditions for Stripping | | | | | |
|---|---|---|---|---|---|---|
| Run No. | 1 | 2 | 3 | 4 | 5 | 6 |
| pH | 10.5 | 10.5 | 8.7 | 8.7 | 7.6 | 7.6 |
| air flow (1/min) ±20% | 60 | 82 | 60 | 82 | 60 | 82 |

The amount of total cyanide ($CN_T$) and Method C cyanide ($CN_{WAD}$) was measured both in parts per million and in milligrams for the slurry in column 1 and the caustic solution in column 2. The results are shown in Table III.

The first column labeled "Hours Stripping" lists the six runs and the time each sample was taken. The second column labeled "Kilograms in System" is the kilograms of liquor in the first column. Initially, 10 kilograms of total slurry was added, made up of liquor and solid tailings. The third and fourth columns list the $CN_T$ and $CN_{WAD}$ measurements in parts per million for each run at each time period listed. The fifth and sixth columns list the $CN_T$ and $CN_{WAD}$ in milligrams. The seventh and eighth columns list the same measurements as in the sixth and seventh columns except they have been adjusted as to account for the samples which were removed.

Columns 2 through 8 list measurements taken from the slurry in column 1. Columns 9 through 14 list similar measurements which were performed on the caustic solution in column 2 in order to determine the total amount of cyanide absorbed. The percent extraction of $CN_T$ and $CN_{WAD}$ are listed in columns 15 and 16.

The percentage extraction of $CN_T$ is based on the total $CN_T$ figure for that particular hour and includes the adjustments. The extraction percentages are low because the CN drained from the slurry column is actually not available for stripping. A caustic sample was lost in run number 4 and therefore there are no corresponding numbers. In runs 1 and 2 the milligram $CN_{WAD}$ analysis was not performed on the slurry.

The 10 liters of initial slurry for runs 3 and 4 required 75 milliliters of a 10 volume percent sulfuric acid solution to reduce the pH to pH 8.7. For runs 5 and 6, 115 milliliters of a 10 volume percent $H_2SO_4$ solution was added to the 10 liters of slurry to reduce the pH to 7.6.

TABLE III

| | Analyses and Balances of Cyanide | | | | | | | | | | | | | | |
|---|---|---|---|---|---|---|---|---|---|---|---|---|---|---|---|
| | SLURRY | | | | | | | CAUSTIC | | | | | | | |
| HOURS | kg.* in. | ppm CN | | mg CN | | ADJ. ∂mg CN | | kg. in | ppm | mg | ADJ. mg | Total CN | | % Extn | |
| STRIPPING | system | T | WAD | T | WAD | T | WAD | system | CN | CN | CN | T | WAD | T | WAD |
| RUN 1 | | | | | | | | | | | | | | | |
| 0 | 7.91 | 163 | 162 | 1290 | | 1290 | | 10.0 | 0 | 0 | 0 | 1290 | | | |
| 1 | 7.91 | 158 | 157 | 1250 | | 1250 | | 10.0 | 9.98 | 100 | 100 | 1350 | | 7.4 | |
| 2 | 7.68 | 150 | 147 | 1150 | | 1190 | | 9.64 | 20.3 | 196 | 200 | 1390 | | 14.4 | |
| 3 | 7.50 | 141 | 143 | 1060 | | 1120 | | 9.41 | 29.0 | 273 | 281 | 1400 | | 20.1 | |
| 4 | 7.20 | 134 | 132 | 965 | | 1070 | | 9.12 | 38.1 | 347 | 364 | 1430 | | 25.5 | |
| RUN 2 | | | | | | | | | | | | | | | |
| 0 | 7.87 | 163 | 162 | 1280 | | 1280 | | 10.0 | 0 | 0 | | 1280 | | | |
| 0.9 | 7.87 | 157 | 1.58 | 1240 | | 1240 | | 10.0 | 13.0 | 130 | 130 | 1370 | | 9.5 | |
| 1.8 | 7.61 | 141 | 142 | 1070 | | 1110 | | 9.55 | 24.7 | 236 | 242 | 1350 | | 17.9 | |
| 2.7 | 7.38 | 136 | 137 | 1000 | | 1070 | | 9.22 | 34.0 | 313 | 327 | 1400 | | 23.4 | |
| 3.6 | 7.15 | 114 | 114 | 815 | | 920 | | 8.77 | 44.2 | 388 | 417 | 1310 | | 31.8 | |
| RUN 3 | | | | | | | | | | | | | | | |
| 0 | 7.97 | 163 | 162 | 1300 | 1290 | 1300 | 1290 | 10.0 | 0 | 0 | 0 | 1300 | 1290 | | |
| 0.9 | 7.97 | 50.6 | 40 | 403 | 319 | 403 | 319 | 10.0 | 91.3 | 913 | 913 | 1320 | 1230 | 69.2 | 74.2 |
| 1.8 | 7.71 | 26.6 | 18.3 | 205 | 141 | 218 | 151 | 9.31 | 109 | 1040 | 1080 | 1300 | 1230 | 83.1 | 87.8 |
| 2.7 | 7.44 | 20.5 | 11.7 | 153 | 87.0 | 173 | 102 | 9.08 | 116 | 1050 | 1140 | 1310 | 1240 | 87.0 | 91.9 |
| 3.6 | 7.17 | 18.0 | 8.9 | 129 | 63.8 | 155 | 82.3 | 8.65 | 120 | 1040 | 1180 | 1330 | 1260 | 88.7 | 93.7 |
| RUN 4 | | | | | | | | | | | | | | | |
| 0 | 7.91 | 163 | 162 | 1290 | 1280 | 1290 | 1280 | 10.0 | 0 | 0 | 0 | 1290 | 1280 | | |
| 0.9 | 7.91 | 33.9 | 27.2 | 268 | 215 | 268 | 215 | 10.0 | 102 | 1020 | 1020 | 1290 | 1240 | 79.1 | 82.2 |
| 1.8 | 7.63 | 18.5 | 15.6 | 141 | 119 | 150 | 127 | 9.64 | 112 | 1080 | 1120 | 1170 | 1250 | 95.7 | 89.6 |
| 2.7 | 7.35 | 16.3 | 11.2 | 120 | 82.3 | 135 | 94.3 | 9.28 | 119 | 1104 | 1180 | 1220 | 1270 | 96.7 | 92.9 |
| 3.6 | 7.04 | 15.2 | 9.8 | 107 | 69.0 | 127 | 84.5 | 8.88 | SAMPLE LOST | | | | | | |
| RUN 5 | | | | | | | | | | | | | | | |
| 0 | 7.54 | 163 | 162 | 1230 | 1220 | 1230 | 1220 | 10.0 | 0 | 0 | 0 | 1230 | 1220 | | |
| 0.9 | 7.54 | 37.2 | 31.4 | 280 | 237 | 280 | 237 | 10.0 | 89.3 | 893 | 893 | 1170 | 1130 | 76.3 | 79.0 |
| 1.8 | 7.24 | 22.2 | 14.0 | 161 | 101 | 172 | 110 | 9.55 | 105 | 1000 | 1040 | 1210 | 1150 | 86.0 | 90.4 |
| 2.7 | 6.93 | 17.4 | 10.4 | 121 | 72.1 | 139 | 85.9 | 9.07 | 107 | 970 | 1060 | 1200 | 1150 | 88.3 | 92.2 |
| 3.6 | 6.70 | 13.6 | 8.9 | 91 | 59.6 | 113 | 75.8 | 8.74 | 101 | 883 | 1010 | 1120 | 1090 | 90.2 | 92.7 |
| RUN 6 | | | | | | | | | | | | | | | |
| 0 | 7.85 | 163 | 162 | 1280 | 1270 | 1280 | 1270 | 10.0 | 0 | 0 | 0 | 1280 | 1270 | | |
| 0.9 | 7.85 | 31.7 | 23.4 | 249 | 184 | 249 | 184 | 10.0 | 91.8 | 918 | 918 | 1170 | 1100 | 78.5 | 83.5 |

TABLE III-continued

| HOURS STRIPPING | Analyses and Balances of Cyanide: SLURRY kg.* in. system | ppm CN T | ppm CN WAD | mg CN T | mg CN WAD | ADJ. ϕmg CN T | ADJ. ϕmg CN WAD | CAUSTIC kg. in system | ppm CN | mg CN | ADJ. mg CN | Total CN T | Total CN WAD | % Extn T | % Extn WAD |
|---|---|---|---|---|---|---|---|---|---|---|---|---|---|---|---|
| 1.8 | 7.55 | 22.2 | 11.6 | 168 | 87.6 | 259 | 94.6 | 9.60 | 112 | 1075 | 1100 | 1360 | 1190 | 80.9 | 92.4 |
| 2.7 | 7.24 | 16.1 | 9.9 | 117 | 71.7 | 132 | 82.3 | 9.14 | 114 | 1040 | 1130 | 1280 | 1230 | 89.8 | 93.5 |
| 3.6 | 6.92 | 15.2 | 8.6 | 105 | 59.5 | 126 | 73.3 | 8.77 | 116 | 1020 | 1190 | 1320 | 1260 | 90.2 | 94.4 |

*kg of liquor
ϕAdjustments to take into account withdrawal

EXAMPLE 2

Following the procedure employed in Example 1, new tests were run on ore samples. In the first run, the air flow was 80 liters per minute (±20%). In the second run, the air flow was 100 liters per minute (±20%). The compositions before and after the runs are shown in Table IV.

The pH of the initial slurry was pH 8.1. This pH was achieved by adding 110 milliliters of 10 volume percent $H_2SO_4$ to the 10 liters of slurry. After run number 1, 7.7 grams of $CA(OH)_2$ was added to the tails to raise the pH to 9.7. After run number 2, 9.0 grams of CA(OH)2 was added to the tails to raise the pH to 10.0. The results for runs number 1 and 2 in Example 2 are shown in Table V.

TABLE V

| HOURS STRIPPING | Analyses and Balances of Cyanide: SLURRY kg.* in system | ppm CN T | ppm CN WAD | mg CN T | mg CN WAD | ADJ. ϕmg CN T | ADJ. ϕmg CN WAD | NaOH kg. in system | ppm CN | mg CN | ADJ. mg CN | Total CN T | Total CN WAD | % Extn T | % Extn WAD |
|---|---|---|---|---|---|---|---|---|---|---|---|---|---|---|---|
| RUN 1 | | | | | | | | | | | | | | | |
| 0 | 7.94 | 213 | 218 | 1690 | 1730 | 1690 | 1730 | 10.0 | 0 | 0 | 0 | 1690 | 1730 | | |
| 1 | 7.94 | 41.7 | 16.7 | 331 | 133 | 331 | 133 | 10.0 | 95.4 | 954 | 954 | 1290 | 1090 | 74.0 | 87.5 |
| 2 | 7.66 | 36.3 | 11.3 | 278 | 86.6 | 290 | 91.3 | 9.69 | 95.8 | 928 | 957 | 1250 | 1080 | 76.6 | 88.6 |
| 3 | 7.36 | 33.0 | 10.0 | 243 | 73.6 | 265 | 81.6 | 9.32 | 100 | 932 | 997 | 1260 | 1080 | 79.1 | 92.3 |
| 4 | 7.05 | 25.5 | 6.0 | 180 | 42.3 | 213 | 53.5 | 8.94 | 98.7 | 882 | 985 | 1200 | 1040 | 82.1 | 94.7 |
| RUN 2 | | | | | | | | | | | | | | | |
| 0 | 8.02 | 213 | 218 | 1710 | 1750 | 1710 | 1750 | 10.0 | 0 | 0 | 0 | 1710 | 1750 | | |
| 1 | 8.02 | 37.2 | 17.2 | 298 | 138 | 298 | 138 | 10.0 | 122 | 1220 | 1220 | 1520 | 1360 | 80.0 | 89.7 |
| 2 | 7.72 | 26.0 | 8.2 | 201 | 63.3 | 212 | 68.4 | 9.63 | 138 | 1330 | 1380 | 1590 | 1450 | 86.8 | 95.2 |
| 3 | 7.46 | 25.5 | 10.2 | 190 | 76.1 | 208 | 83.3 | 9.28 | 133 | 1230 | 1320 | 1530 | 1400 | 86.3 | 94.3 |
| 4 | 7.14 | 23.5 | 12.4 | 168 | 88.5 | 194 | 99.1 | 8.95 | 138 | 1240 | 1380 | 1570 | 1480 | 87.9 | 93.2 |

*kg of liquor
ϕadjustments to take into account withdrawals

TABLE IV

| Composition of Barren Leachate Before and After Stripping | | | |
|---|---|---|---|
| Run No. | | AFTER | |
| Air Flow (l/min ± 20%) | BEFORE | 1 80 | 2 100 |
| pH | 10.4 | 9.7 | 10.2 |
| alkalinity | 575 | 170 | 169 |
| $CN_T$ | 213 | 29.4 | 24.6 |
| $CN_{WAD}$ | 218 | 7.4 | 6.8 |
| hardness | 307 | 2170 | 2030 |
| $SO_4$ | 360 | 2525 | 2350 |
| SCN | 34 | 37 | 38 |
| E.C. (μS/cm 20° C.) | 1710 | | |
| As | 0.8 | 0.8 | 0.7 |
| Ca | 123 | 869 | 814 |
| Cd | <0.01 | <0.01 | <0.01 |
| Cr | 0.02 | <0.02 | <0.02 |
| Co | 0.16 | 0.33 | 0.30 |
| Cu | 4.7 | 6.0 | 6.1 |
| Fe | 1.3 | 8.7 | 6.7 |
| Pb | <0.1 | <0.1 | <0.1 |
| Mn | 0.01 | 0.02 | 0.02 |
| Hg | | | |
| Ni | 0.12 | 0.43 | 0.41 |
| Se | | | |
| Ag | 0.15 | 0.04 | 0.04 |
| Zn | 0.64 | 0.01 | 0.06 |
| Reagent consumption to either lower or raise pH for 10 l slurry | | | |
| final pH | 8.1 | 9.7 | 10.0 |
| reagent | 10% v/v $H_2SO_4$ | $Ca(OH)_2$ | $Ca(OH)_2$ |
| amount | 110 ml | 7.7 g | 9.0 g |

EXAMPLE 3

Five runs were performed in order to test the efficiency of a reactor employing air inlets and a turbine to create turbulence. The pH in each run was varied as was the air flow rate. In run number 1, the pH was 8 and the air flow was 290 liters per minute (2.9 meters$^3$/meters$^2$×minute). In run number 2, the pH was 7.8 and the air flow rate was 100 liters per minute (1.0 meters$^3$/meters$^2$×minute). In run number 3, the pH was 8.2 and the air flow rate was 50 liters per minute (0.5 meters$^3$/meters$^2$×minute). In run number 4, the pH was 7.8 and the air flow rate was 200 liters per minute (2.0 meters$^3$/meters$^2$×minute). In run number 5, the pH was 8 and the air flow rate was 200 liters per minute. In runs 1 through 5, 30 liters of solution were tested. Table VI shows the percent $CN_{WAD}$ remaining after 15, 30, 60, 120 and 180 minutes.

TABLE VI

| Time (minutes) | Run 1 | 2 | 3 | 4 | 5 |
|---|---|---|---|---|---|
| | Percent $CN_{WAD}$ Remaining | | | | |
| 15 | 59.6 | 76.6 | 96.8 | 52.1 | 66.2 |
| 30 | 36.5 | 58.5 | 92.5 | 33.3 | 42.1 |
| 60 | 27.4 | 46.3 | 46.2 | 20.8 | 24.8 |
| 120 | 22.1 | 30.3 | 35.5 | 12.5 | 21.1 |
| 180 | 19.2 | 23.4 | 33.3 | | 13.5 |

EXAMPLE 4

The efficiency of a flotation machine and a diffuser column were tested in runs 1 and 2 of Example 4, respectively. In run number 1, a flotation machine was employed with a 40 liter per minute air flow into a 3 liter slurry (1.4 meters$^3$/meters2×minute). In run number 2, a diffuser column was employed with 50 liters per minute air introduced into a 10 liter slurry (9.4 meters$^3$/meters2×minute). In both runs 1 and 2, the pH was 8. The results of these tests are shown in Table VII.

TABLE VII

| Time (minutes) | Run 1 | Run 2 |
|---|---|---|
| | Percent $CN_{WAD}$ Remaining | |
| 15 | 43 | 76 |
| 30 | 20 | 60 |
| 60 | 11 | 46 |
| 120 | 10 | 12 |
| 180 | 8 | 7 |

While various embodiments of the present invention have been described in detail, it is apparent that modifications and adaptations of those embodiments will occur to those skilled in the art. However, it is to be expressly understood that such modifications and adaptations are within the spirit and scope of the present invention, as set forth in the following claims.

What is claimed is:

1. A process for regenerating cyanide from a cyanide-containing solution comprising:

(a) adjusting the pH of the cyanide-containing solution to a pH in the range from pH 7 to about pH 9.5, (b) volatilizing HCN in the pH adjusted solution, and (c) contacting the volatilized HCN with a basic material.

2. The process of claim 1 wherein the pH of the cyanide-containing solution is adjusted to about pH 8.

3. The process of claim 1 wherein said adjustment of the pH of the cyanide-containing solution is accomplished using an acid.

4. The process of claim 3 wherein said acid is $H_2SO_4$.

5. The process of claim 1 wherein the volatilization of HCN in the pH adjusted solution is accomplished by introducing air into the pH adjusted solution or by introducing the pH adjusted solution into air.

6. The process of claim 1 wherein said contacting of the volatilized HCN and basic material is accomplished in a countercurrent flow scrubber.

7. The process of claim 1 wherein the volatilized HCN is contacted with a basic solution.

8. The process of claim 7 wherein said basic solution comprises NaOH solution.

9. The process of claim 7 wherein said basic solution comprises a lime solution.

10. A process for regenerating cyanide from the tailings slurry resulting from a mineral recovery process employing cyanide leach solution, said regeneration process comprising:

(a) adjusting the pH of the tailing slurry to a pH in the range from pH 7 to about pH 9.5, (b) volatilizing HCN in the pH adjusted slurry, and (c) contacting the volatilized HCN with a basic material.

11. The process of claim 10 wherein the pH of the tailing slurry is adjusted to about pH 8.

12. The process of claim 10 wherein said adjustment of the pH of the tailings slurry is accomplished using an acid.

13. The process of claim 12 wherein said acid is $H_2SO_4$.

14. The process of claim 10 wherein the volatilization of HCN in the pH adjusted slurry is accomplished by introducing air into the pH adjusted slurry or by introducing the pH adjusted slurry into air.

15. The process of claim 10 wherein said contacting of the volatilized HCN and basic material is accomplished in a countercurrent flow scrubber.

16. The process of claim 10 wherein the volatilized HCN is contacted with a basic solution.

17. The process of claim 16 wherein said basic solution comprises NaOH solution.

18. The process of claim 16 wherein said basic solution comprises a lime solution.

19. The process of claim 10 further comprising the step of adjusting the pH of the treated tailings to a pH in the range from about pH 9.5 to about pH 10.5.

20. The process of claim 20 further comprising the step of coagulating metal complexes in the treated tailings.

21. The process of claim 20 wherein said coagulation is accomplished by adding $FeCl_3$, an organic sulfide or mixtures thereof.

22. The process of claim 10 further comprising the step of impounding the treated tailings.

23. The process of claim 10 further comprising the step of recycling the regenerated cyanide to a mineral recovery process.

24. The process of claim 10 further comprising the step of removing additional cyanide from the treated tailings.

25. The process of claim 24 wherein said additional cyanide is removed by oxidation.

26. The process of claim 25 wherein $H_2O_2$ is employed to oxidize said additional cyanide.

27. A process for regenerating cyanide from the tailings slurry resulting from a carbon-in-leach or carbon-in-pulp gold recovery process employing cyanide leach solution, said regeneration process comprising:

(a) adjusting the pH of the tailings slurry to between about pH 7 and about pH 9 using an acid selected from the group consisting of sulfuric acid, hydrochloric acid, acetic acid, nitric acid and mixtures thereof, (b) volatilizing HCN in the pH adjusted slurry by introducing air into the pH adjusted slurry or by introducing the pH adjusted slurry into air, (c) contacting the volatilized HCN with a basic solution selected from the group consisting of NaOH solution and lime solution in a countercurrent flow gas scrubber, (d) coagulating metal complexes in the treated tailings, (e) adjusting the pH of the treated tailings to a pH in the range from about pH 9.5 to about pH 10.5, (f) removing additional cyanide from the treated tailings, (g) impounding the treated tailings, and (h) recycling the basic cyanide solution to the gold recovery process.

* * * * *

UNITED STATES PATENT AND TRADEMARK OFFICE

CERTIFICATE OF CORRECTION

PATENT NO. : 4,994,243

DATED : February 19, 1991

INVENTOR(S) : Adrian J. Goldstone and Terry I. Mudder

It is certified that error appears in the above-identified patent and that said Letters Patent is hereby corrected as shown below:

Column 6, line 16, after "26" insert a comma.

Column 7, line 40, after "26" insert a comma.

Column 13, line 7, delete "meters2" and insert therefor --meters$^2$--.

Column 13, line 10, delete "meters2" and insert therefor --meters$^2$--.

Column 14, Claim 11, line 2, delete "tailing" and insert therefor --tailings--.

Column 14, Claim 20, line 1, delete "claim 20" and insert therefor --claim 18--.

Signed and Sealed this

Twelfth Day of January, 1993

*Attest:*

*Attesting Officer*

DOUGLAS B. COMER

*Acting Commissioner of Patents and Trademarks*